US006104368A

United States Patent [19]

Bonnett et al.

[11] Patent Number: 6,104,368

[45] Date of Patent: Aug. 15, 2000

[54] DIFFRACTIVE LIQUID CRYSTAL DEVICE

[75] Inventors: Paul Bonnett, Littlemore; Nicholas Mayhew, Oxford; Michael Geraint Robinson; Craig Tombling, both of Stadhampton; Michael John Towler, Botley, all of United Kingdom

[73] Assignee: Sharp Kabushiki Kaisha, Osaka, Japan

[21] Appl. No.: 09/052,213

[22] Filed: Mar. 31, 1998

[30] Foreign Application Priority Data

Apr. 4, 1997 [GB] United Kingdom ..... 9706836

[51] Int. Cl.[7] ..... G09G 3/36

[52] U.S. Cl. ..... 345/94; 345/96; 345/103

[58] Field of Search ..... 345/98, 99, 100, 345/103, 94, 95, 96, 97, 208, 209, 210, 211

[56] References Cited

U.S. PATENT DOCUMENTS

| | | | |
|---|---|---|---|
| 4,345,249 | 8/1982 | Togashi | 345/103 |
| 4,688,896 | 8/1987 | Castleberry | 345/103 |
| 5,041,821 | 8/1991 | Onitsuka et al. | 340/784 |

FOREIGN PATENT DOCUMENTS

| | | |
|---|---|---|
| 0811872 | 12/1997 | European Pat. Off. . |
| 6-160822 | 6/1994 | Japan . |
| 2313920 | 12/1997 | United Kingdom . |
| 9714990 | 4/1997 | WIPO . |

OTHER PUBLICATIONS

P. W. H. Surguy et al., Ferroelectrics, vol. 122, pp. 63–79, 1991, "The "Joers/Alvey" Ferroelectric Multiplexing Scheme".

J. R. Hughes et al., Liquid Crystals, vol. 13, No. 4, pp. 597–601, 1993, "A New Set of High Speed Matrix Addressing Schemes for Ferroelectric Liquid Crystal Displays".

*Primary Examiner*—Xiao Wu

[57] ABSTRACT

A diffractive liquid crystal device includes a bistable liquid crystal arranged as pixels with each pixel being addressed by a strobe electrode and a pair of interdigitated data electrodes. A strobe generator supplies an initial blanking pulse to each of the strobe electrodes and then supplies strobe pulses in sequence to the strobe electrodes for at least several frames without any more blanking pulses. A data signal generator supplies data signals to the pairs of data electrodes which switch each pixel to a diffractive or non-diffractive state irrespective of its previous state. In particular, the strobe signals comprise pulses of opposite direction in consecutive frames. To select the non-diffractive pixel state, switching signals are applied to both the first and second electrodes during each frame. To select the diffractive pixel state, the first and second electrodes receive non-switching and switching pulses, respectively, during odd frames and switching and non-switching pulses, respectively, during even frames. This arrangement may be periodically reversed for DC compensation.

12 Claims, 16 Drawing Sheets

DIFFRACTIVE LIQUID CRYSTAL DEVICE

The present invention relates to a diffractive liquid crystal device. For instance, such a device may comprise a ferroelectric liquid crystal (FLC) grating display for use in a projection display.

FIG. 1 of the accompanying drawings illustrates a known type of FLC display panel comprising an array of m rows and n columns of picture elements (pixels). The display comprises column or data electrodes 1 connected to respective outputs of a data signal generator 2 so as to receive data signals Vd1, Vd2 . . . Vdn. The generator 2 has a data input 3 for receiving data to be displayed, for instance one row at a time. The generator 2 has a synchronising input 4 for receiving timing signals so as to control the supply of the data signals to the data electrodes The display further comprises row or strobe electrodes 5 connected to respective outputs of a strobe signal generator 6 so as to receive respective strobe signals Vs1, Vs2 . . . Vsm. The generator 6 has a synchronising input which is also connected to receive timing signals for controlling the timing of supply of the strobe signals to the strobe electrodes 5.

The display further comprises an FLC arranged as a layer between the data electrodes 1 and the strobe electrodes 5. The FLC is bistable and has a minimum in its τ-V characteristic. The liquid crystal layer is disposed between parallel rubbed alignment layers. The intersections between the data and strobe electrodes define individual pixels which are addressable independently of each other.

FIG. 2 of the accompanying drawings is a timing diagram illustrating the timing and waveforms of the data and strobe signals for the display of FIG. 1. The strobe signals Vs1, Vs2, . . . Vsm are supplied in sequence to the strobe electrodes with each strobe signal occupying a respective time slot. Thus, the strobe signal Vs1 is supplied during the time slot $t_0$ to $t_1$, the strobe signal Vs2 is supplied during the time slot $t_1$ to $t_2$, and so on with the sequence repeating after all of the electrodes 5 have been strobed to complete a frame of data at time $t_m$.

Each time slot is divided into four sub-slots, for instance as illustrated for the first time slot with the sub-slots starting at $t_0$, $t_a$, $t_b$ and $t_c$. During each active time slot, for instance the first time slot of the frame for the strobe signal Vs1, the strobe signal may have any suitable form. In FIG. 2 by way of example, the strobe signal is illustrated as having zero level for the fist two sub-slots and a predetermined level for the third and fourth sub-slots. In order to prevent DC imbalance, the polarities of the strobe signals are reversed after each complete frame of data. The data signals Vd1, Vd2 . . . Vdn are supplied simultaneously with each other and in synchronism with the strobe signals as shown in FIG. 2. For the purpose of illustration, each data signal is illustrated by a rectangular box in FIG. 2. Also, gaps are shown between consecutive data signals for the purpose of clarity although, in practice, consecutive data signals are contiguous.

FIG. 3 illustrates typical strobe and data waveforms of the JOERS/ALVEY drive scheme as disclosed in P. W. H. Surguy, et al, Ferroelectrics 122, 63, 1991. The JOERS/ALVEY drive scheme is suitable for use with FLC materials having low spontaneous polarisations Ps and showing τ-Vmin behaviour. A blanking pulse is supplied to each strobe electrode 5, for instance at the start of each frame or before each line address time (LAT). The blanking pulse resets all of the pixels addressed by the strobe electrode 5, normally to a dark state. The blanking pulse is followed by a strobe pulse and data pulses are simultaneously supplied to all the data electrodes 1 so as to enter next row of image data in the display. The data signal supplied to each data electrode 1 may be a switching pulse SW for switching the pixel to its bright state or a non-switching pulse NSW such that the pixel remains in its dark state. The resultant switching and non-switching pulses applied across the pixels are illustrated in FIG. 3.

The so-called Malvern extensions are illustrated in broken line in FIG. 3 and have the effect of extending the strobe pulse. This technique is disclosed in J. R. Hughes, E. P. Raynes, Liquid Crystals 13, 597, 1993. This technique enhances the speed and contrast of the display. The LAT is reduced at the expense of the size of the drive window.

Such techniques allow the use of a passive matrix addressing arrangement with a bistable liquid crystal such as FLC. At the start of each frame or at the start of each line of each frame, all the pixels or the line of pixels are blanked to their dark state. Data to be displayed are then written to the display a line at a time and the bistability of the liquid crystal material ensures that the selected optical state is held until the pixel is blanked and refreshed during the next frame.

A disadvantage of such an arrangement is the loss of contrast and brightness which results from the blanking of the pixels before refreshing. In particular, for a certain proportion of each frame time, each pixel is always blanked to one of its stable states. In general, this is its dark state so as to provide a visually more acceptable display. Where a pixel is to be switched to its light state, the brightness and contrast are reduced because the pixel only spends a fraction of the frame in its desired bright state.

A diffractive spatial light modulator and display are disclosed in GB 2 313 920 and EP 0 811 872, the contents of which are incorporated herein by reference. A high resolution electrode structure is used to switch FLC into fine pitch regions suitable for the diffraction of light, for instance for use in a high brightness projection display. In particular, each pixel is provided with an interdigitated electrode structure such that alternate strips of the FLC may be switched into the same optical state or into a different optical state. When all of the strips are switched to the same state, the pixel does not diffract light, which therefore emerges from the pixel into the zeroth order of diffraction. An optical system for gathering light from the pixels is generally arranged not to gather light in this mode so that the pixel appears dark When alternate strips of the FLC are switched to different optical states, the pixel acts as a diffraction grating. For instance, the interdigitated strips of FLC may apply different phase delays, for instance differing by 180 degrees, to light passing therethrough. The pixel acts as a diffraction grating with light being diffracted into the non-zeroth diffraction orders where it is collected by the associated optical system so that the pixel appears bright.

The known types of addressing schemes, for instance as illustrated in FIGS. 2 and 3, may be used with such diffractive FLC spatial light modulators. However, because each pixel is blanked to its dark state during part of each frame, there is a loss of brightness and contrast as described hereinbefore.

One possible way of avoiding this disadvantage would be to compare the new pixel data with the existing pixel data so as to apply a switching signal only to those pixels whose optical state has to be changed. Such an arrangement would avoid the need for blanking the pixels before supplying fresh image data. However, such an arrangement is inconvenient in that the states of all the pixels would have to be stored, for instance in a frame memory, so as to ascertain whether a switching signal should be supplied to each pixel. In addition to the cost of providing a frame store, additional processing circuitry is required to perform the comparison, Thus, the complexity is increased and hence the manufacturing yield is reduced, both of which lead to increased cost.

According to the invention, there is provided a diffractive liquid crystal device comprising: a layer of bistable liquid crystal; a plurality of strobe electrodes; a plurality of pairs of data electrodes; a plurality of picture elements, each of which is formed at an intersection of a respective one of the strobe electrodes and a respective one of the pairs of data electrodes, the data electrodes of each pair being interdigitated at each picture element; a strobe signal generator for supplying strobe signals to the strobe electrodes such that each strobe electrode receives strobe signals of alternate polarity in consecutive frames of a first time period; and a data signal generator for supplying first and second data signals to first and second ones of the data electrodes, respectively, of each pair in synchronism with each strobe signal, characterised in that the strobe signals do not include blanking signals between the frames of the fist time period and in that the first and second data signals comprise, during the first time period: switching signals for selecting a non-diffractive picture element state; a switching signal and a non-switching signal, respectively, in odd frames for selecting a diffractive picture element state; and a non-switching signal and a switching signal, respectively, in even frames for selecting a diffractive picture element state.

It is thus possible to provide a diffractive liquid crystal device which does not require blanking before refreshing each pixel so that the brightness and contrast are improved. The strobe and data signals are such that switching to the desired diffractive or non-diffractive state does not depend on the previous state of a pixel.

The strobe signal generator may be arranged to supply to each of the strobe electrodes a first blanking signal preceding and of opposite polarity to that of the strobe signal of a first frame of the first period. The strobe signal generator may be arranged to supply the first blanking signals simultaneously to the strobe electrodes. In order for correct operation of the device, it is sufficient for a blanking operation to be performed at the start of the first period, for instance when the display is first switched on. It is not then necessary to perform blanking of each pixel during each frame.

In one embodiment, the data signal generator is arranged to supply, during a second time period following the first time period, the first and second data signals comprising: switching signals for selecting a non-diffractive picture element state; a non-switching signal and a switching signal, respectively, in odd frames for selecting a diffractive picture element state; and a switching signal and a non-switching signal, respectively, in even frames for selecting a diffractive picture element state. The pixels may be blanked at the start of the second time period, for instance at the start of the first frame or at the start of each LAT of the first frame.

In another embodiment, the strobe signal generator is arranged to supply, during a second time period following the first time period, to each of the strobe electrodes a second blanking signal which is of opposite polarity to that of the first blanking signal and which precedes and is of opposite polarity to that of the strobe signal of a first frame of the second time period. The strobe signal generator may be arranged to supply the second blanking signals simultaneously to the strobe electrodes.

It is thus possible to provide DC balancing of the pixels. Such DC balancing is desirable so as to avoid electrochemical degradation of the liquid crystal.

For convenience, the strobe signals in a first frame of the first time period may be of the same polarity.

The bistable liquid crystal is preferably a ferroelectric liquid crystal, although other materials such as supertwisted nematic (STN), antiferroelectric liquid crystal (AFLC), and bistable nematic (e.g. bistable twisted nematic (BTN)) may be used FLC has the advantage of a rapid response time which allows passively addressed displays of relatively high frame rates to be provided.

The invention will be further described, by way of example, with reference to the accompanying drawings, in which.

Like reference numerals refer to like parts throughout the drawings.

Figure 1:
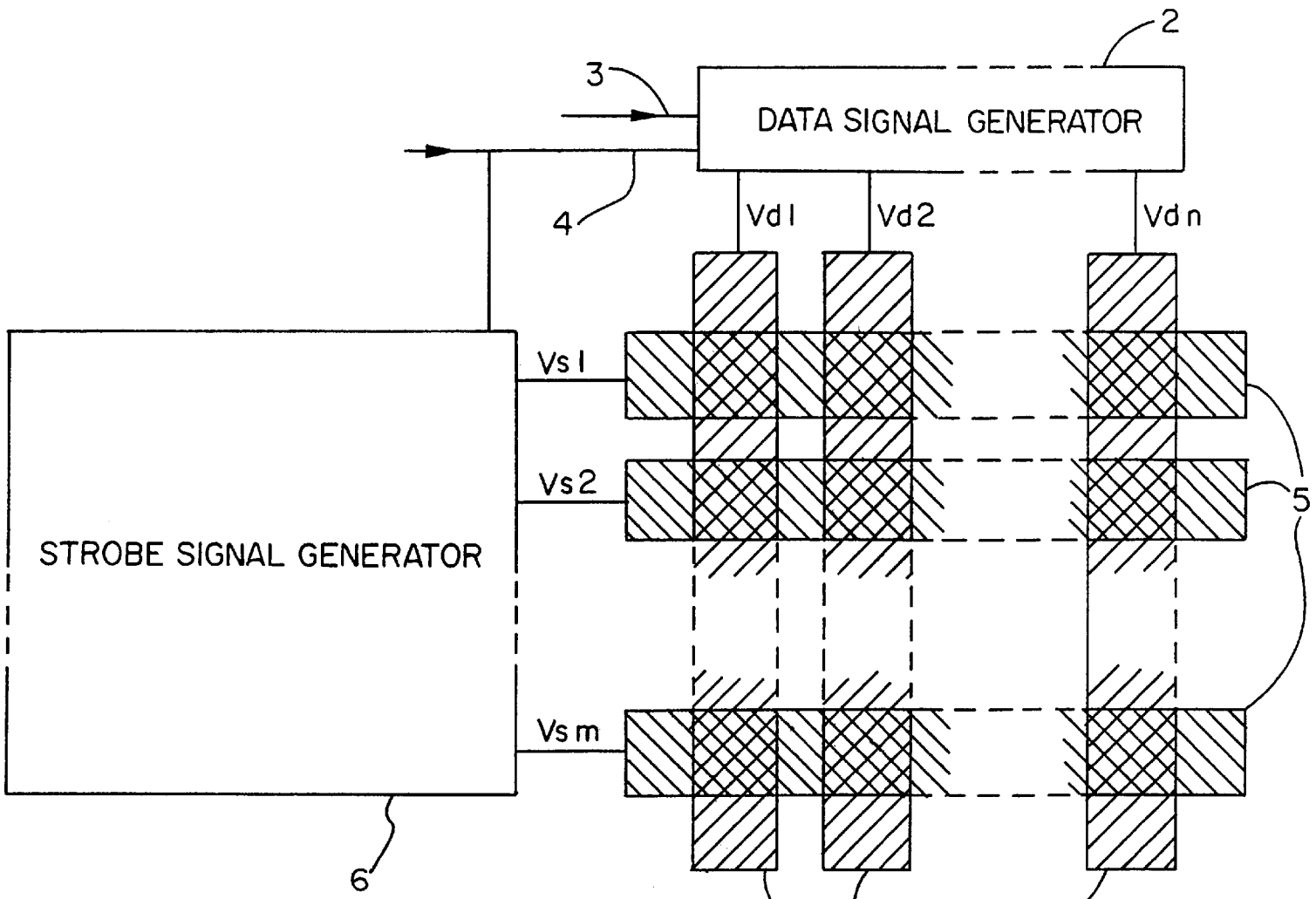
FIG. 1 is a diagrammatic plan view of a known FLC display.
Figure 2:
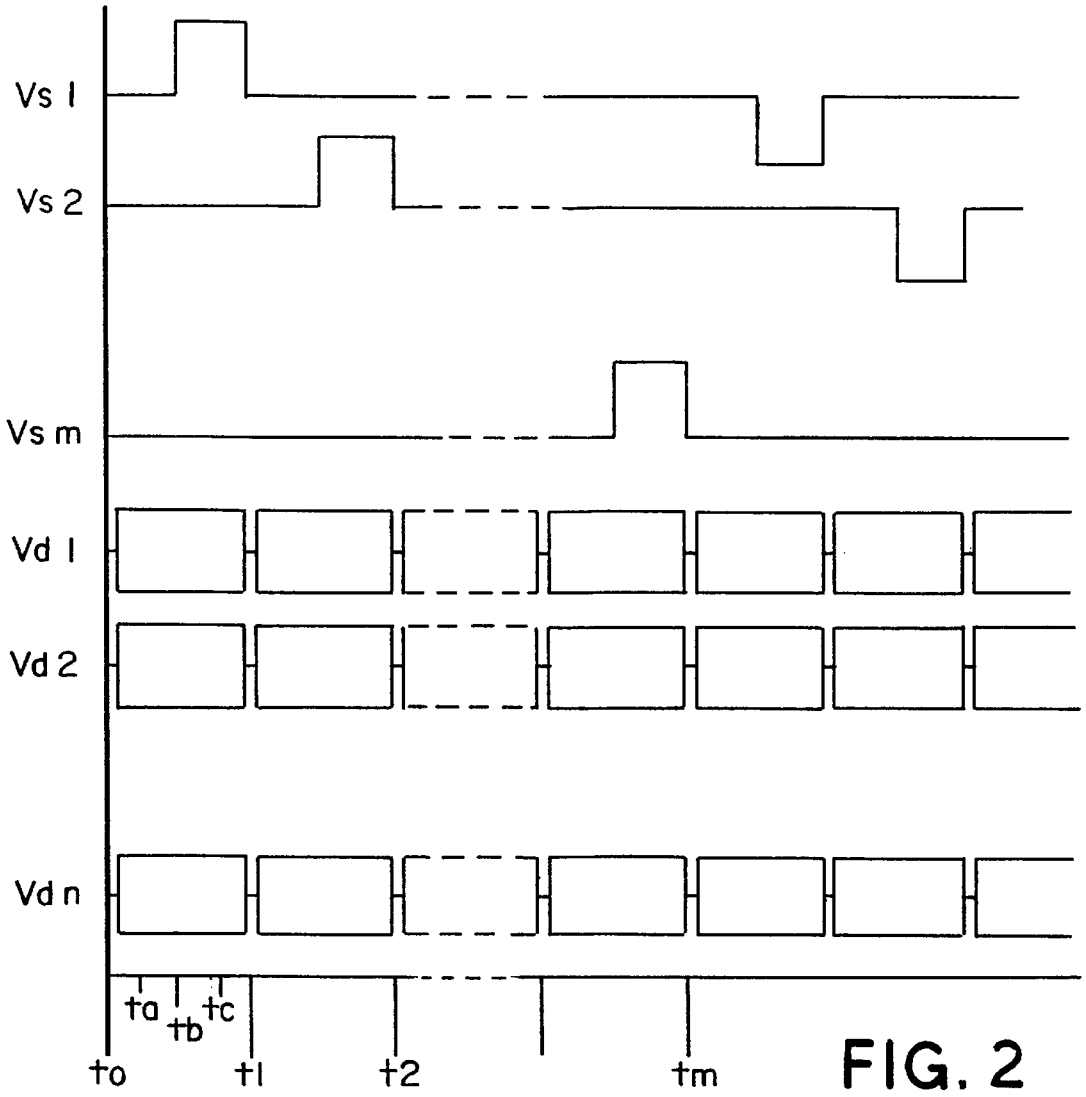
FIG. 2 is a diagram illustrating waveforms occurring in the display of FIG. 1.
Figure 4:
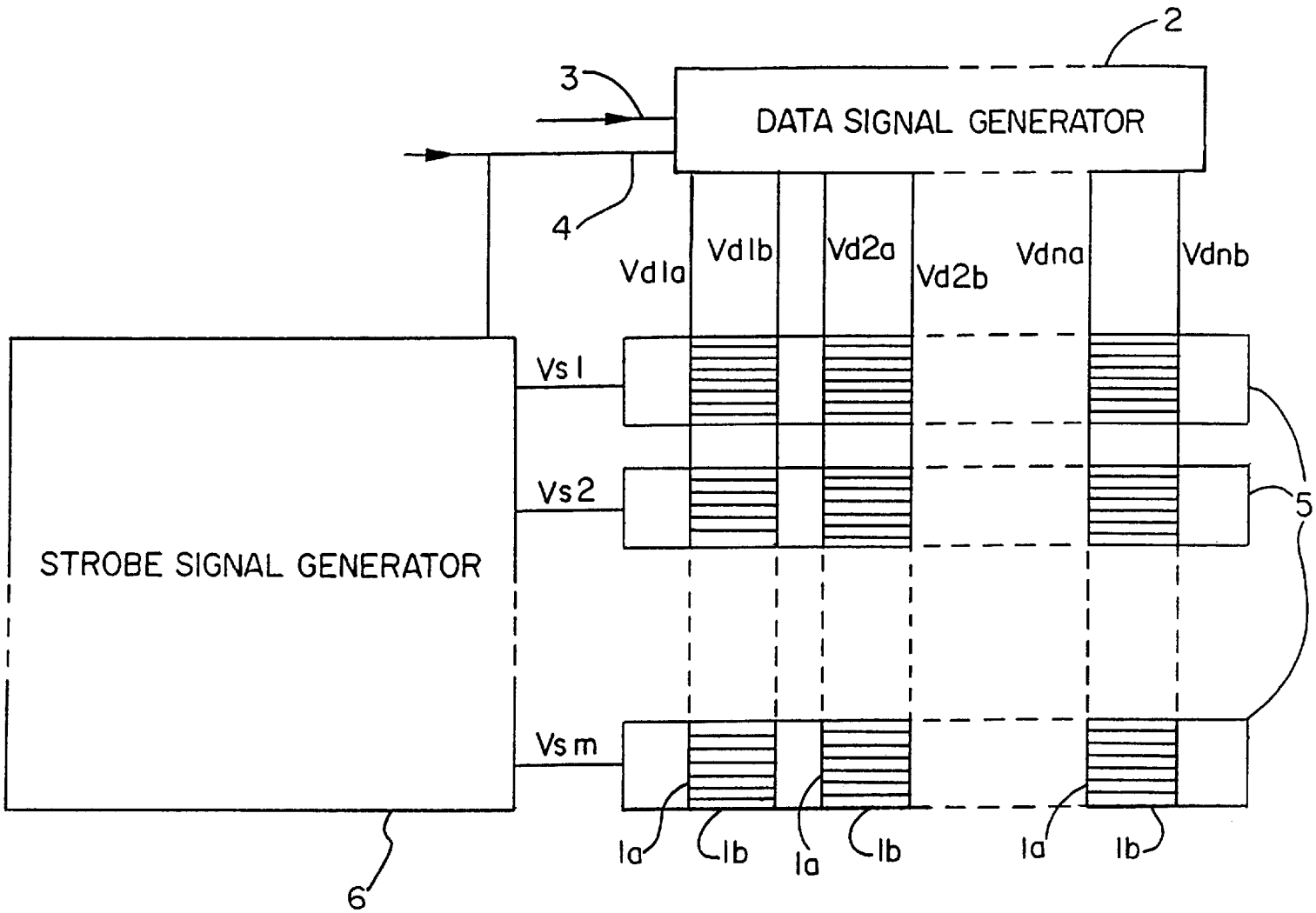
FIG. 4 is a diagrammatic plan view of a diffractive liquid crystal device constituting an embodiment of the invention.
Figure 5:
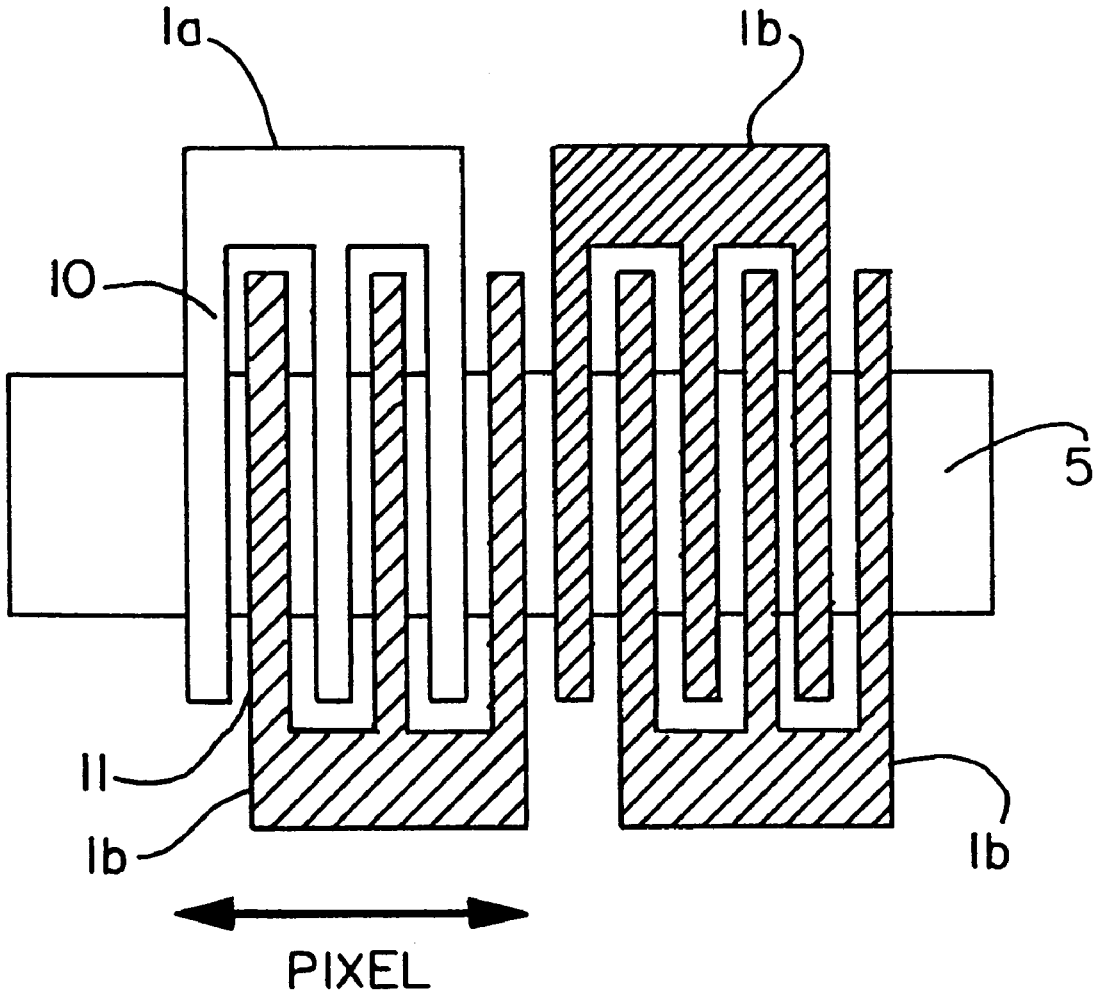
FIG. 5 is a diagram illustrating a detail of the device of FIG. 4.

The diffractive FLC device shown in FIG. 4 is suitable for use as a display panel in projection displays and differs from the device shown in FIG. 1 in that the single data electrodes 1 are replaced by pairs of data electrodes 1*a* and 1*b*. Thus, the pixels of each column are provided with a first data electrode 1*a* and a second data electrode 1*b*. The first and second electrodes 1*a* and 1*b* are interdigitated as shown in more detail in FIG. 5, where the interdigitated parts are shown rotated through 90 degrees compared with the diagrammatic illustration in FIG. 4.

The first electrode 1*a* comprises elongate portions such as 10 which alternate with elongate portions such as 11 of the second electrode 1*b*. The first electrodes 1*a* of each column are connected together to receive first data signals Vd1*a*, Vd2*a*, . . . Vdna whereas the second electrodes 1*b* in each column are connected together to receive respective second data signals Vd1*b*, Vd2*b*, . . . Vdnb.

The elongate portions 10 and 11 cooperate with the strobe electrodes 5 to define parallel strips or subregions of the pixels such that the strips addressed by the first electrodes 1*a* may be switched to either of the two stable states of the FLC whereas the strips addressed by the second electrodes 1*b* may be switched similarly to either state but independently of the first strips. The two stable states of the FLC of each strip will be referred to hereinafter as "up" and "down".

When all of the strips are switched to the same up or down state, a pixel functions as a non-diffractive optical element When the first strips are in the up state and the second strips are in the down state or when the first strips are in the down state and the second strips are in the up state, the pixels function substantially identically as diffraction gratings so as to diffract incident light into non-zero diffraction orders. For instance, the FLC may be such that a phase difference, such as 180 degrees, is produced between light passing through the FLC in the up and down states so that the pixel functions as a phase-only diffraction grating. Such diffraction gratings operate on unpolarised light and therefore allow displays of high optical efficiency to be produced.

The pixels operate in the non-diffractive mode such that light passes into the zeroth diffraction order when the first and second strips as all either in the up state or in the down state. Similarly, the pixels operate as diffraction gratings both when the first strips are in the up state and the second strips are in the down state and when the first strips are in the down state and the second strips are in the up state. This removes the need for pixel blanking in each frame.

Figure 3:
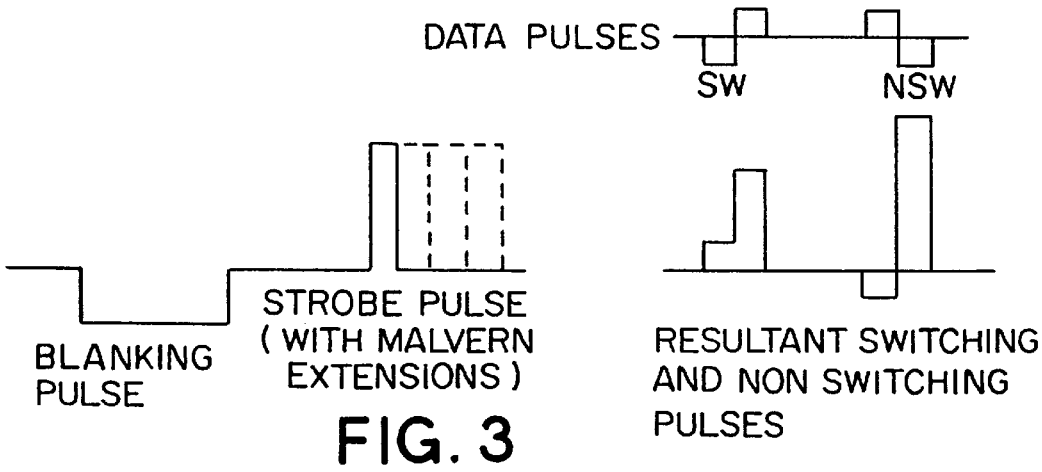
FIG. 3 is a waveform diagram illustrating known addressing waveforms.
Figure 6:
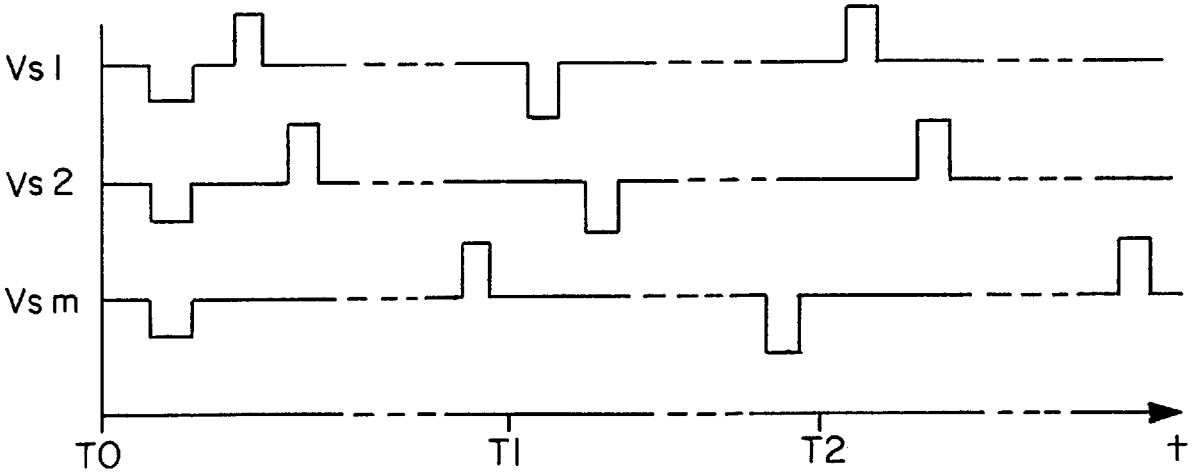
FIGS. 6 and 7 are waveform diagrams illustrating waveforms occurring in the device of FIG. 4.

The waveform diagrams of FIG. 6 illustrate the blanking and strobe signals during a first time period after switching on the device. In particular, these diagrams cover the first three frames starting at times T0, T1 and T2, respectively. Blanking pulses are supplied simultaneously to the strobe electrodes 5 at the start of the first frame, after which strobe pulses are supplied in turn to the electrodes 5. The strobe pulses may be of conventional type, for instance as described hereinbefore with reference to FIG. 3. As shown in FIG. 6, the blanking pulses are applied only during the first frame with no blanking pulses being applied during subsequent frames of the first time period.

Figure 7:
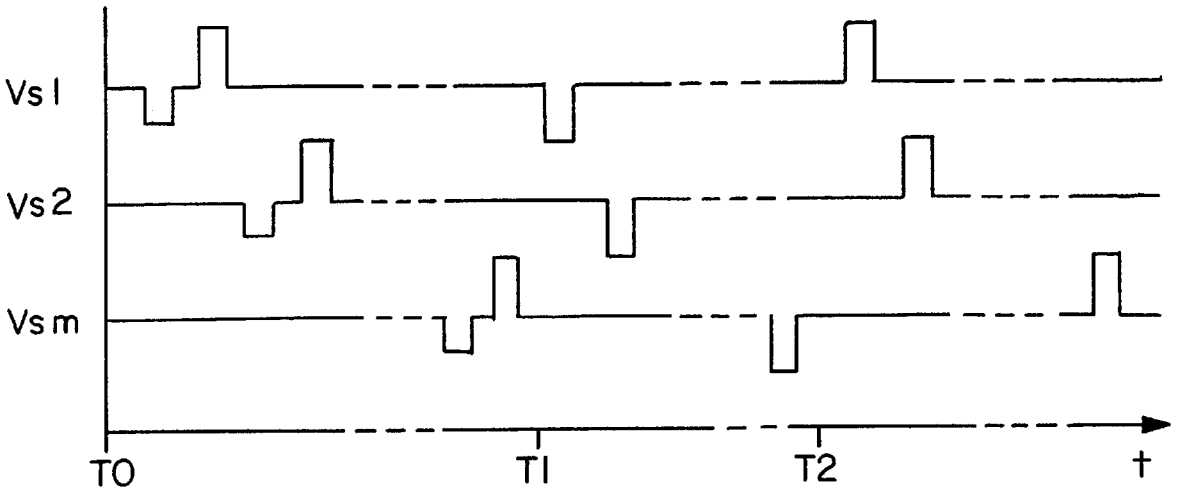

The waveforms shown in FIG. 7 differ from those shown in FIG. 6 in that a blanking pulse is supplied to each strobe electrode 5 immediately before its strobe pulse during the first frame. Again, no subsequent blanking pulses are supplied during the first time period, The data signals Vd1*a*, . . . Vdna, Vd1*b*, . . . Vdnb are supplied simultaneously to the first and second data electrodes 1*a* and 1*b* and in synchronism with each of the strobe pulses. The individual data signals may be switching or non-switching signals and may be of the conventional type described hereinbefore with reference to FIG. 3.

Figure 8:
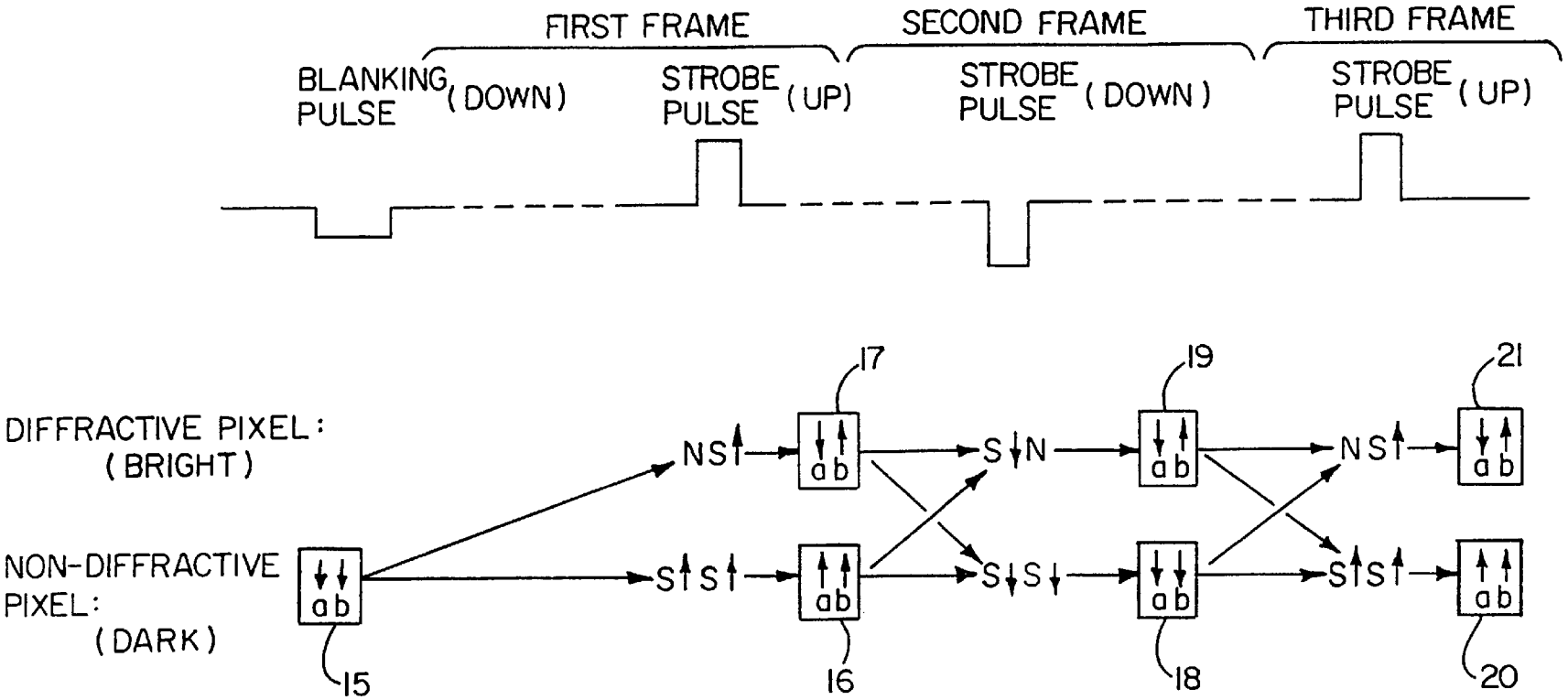
FIGS. 8, 9 and 10 are diagrams illustrating waveforms and operation of the device of FIG. 4.

FIG. 8 illustrates operation of the device of FIG. 4 during the first three frames of the first time period. The operation in FIG. 8 applies to a generic or arbitrary pixel of the device with all pixels being addressed and controlled in the same way.

The blanking pulse has a polarity such that it switches all of the strips of the pixels of the device to the down state. This is illustrated at 15 which represents a pixel and shows the state of the strips controlled by the first data electrode 1*a* by the downwardly pointing arrow above the "a" and the state of the strips controlled by the second data electrode 1*b* by the downwardly pointing arrow above the "b". The pixel represented at 15 is thus in the non-diffractive state and corresponds to a dark pixel in a display of the type which collects light from thc non-zeroth diffractive orders.

During the first frame, in order to maintain the pixel in the non-diffractive state, switching signals indicated by "S" are supplied to both the first and second electrodes 1*a* and 1*b* in synchronism with the strobe pulse of the "up" type such that the switching signals can switch the strips to the up state but not to the down state, as indicated by the upwardly pointing arrows adjacent the switching signals S. Both the first strips and the second strips are in the down state so that the switching signals S applied to the first and second electrodes 1*a* and 1*b* switch the states of the first and second strips to thc up state as shown at 16. Thus, all of the strips are in the same state so that the pixel remains in the non-diffractive state.

If the pixel is to be switched from the blanked state to the diffractive state, then a non-switching signal N is applied to the first electrode 1*a* and a switching signal S is applied to the second electrode 1*b* in synchronism with the up strobe pulse during the first frame. The non-switching signal N applied to the first electrode 1*a* leaves the first strips a in the down state. The switching signal S in combination with the up strobe pulse switches the strips b controlled by the second electrode 1*b* to the up state as illustrated at 17.

In order to switch a generic or arbitrary pixel to the non-diffractive state during the second frame, switching signals S are applied to the first and second electrodes 1*a* and 1*b* in synchronism with the down strobe pulse. If the pixel was already in the non-diffractive state as shown at 16, the switching signals switch all of the strips to the down state as shown at 18 so that the pixel remains in the non-diffractive state. If the pixel was in the diffractive state as illustrated at 17, the first strips a were already in the down state so that the switching signal S applied to the first electrodes causes no change. The second strips b were in the up state but are switched to the down state by the switching signal S applied to the second electrode 1*b*. Thus, again, the states of the strips are as shown at 18.

If the pixel is required to be switched to the diffractive state during the second frame, a switching signal S is applied to the first electrode 1*a* and a non-switching signal N is applied to the second electrode 1*b*. If the pixel was in the non-diffractive state as shown at 16, the switching signal causes the first strips a to switch to the down state whereas the non-switching signal leaves the second strips b unchanged. Thus, the diffractive state illustrated at 19 is set. If the pixel was already in the diffractive state as illustrated at 17, the first strips a were already in the down state so that the switching signal S in combination with the down strobe pulse has no effect. Similarly, the non-switching signal has no effect on the second strips b so that the pixel remains in the same state as illustrated at 19.

During the third frame, an up strobe pulse is supplied. Switching signals are applied to the first and second electrodes 1*a* and 1*b* in order for the pixel to be in the non-diffractive state. If the pixel was in the non-diffractive state as shown at 18, the strips were all in the down state. The switching signals and the up strobe pulse cause all the strips a and b to be switched to the up state as illustrated at 20. If the pixel was in the diffractive state as illustrated at 19, the switching signal S applied to the first electrode 1*a* causes the first strips a to be switched to the up state whereas the switching signal applied to the second electrode 1*b* has no effect because the second strips b were already in the up state. The pixel is therefore switched to the state illustrated at 20.

If the pixel is required to be switched to the diffractive state during the third frame, a non-switching signal N is applied to the first electrode 1*a* and a switching signal S is applied to the second electrode 1*b*. If the pixel was in the non-diffractive state, the non-switching signal causes no change so that the first strips a remain in the down state. The switching signal applied to the second electrode 1*b* causes the second strips b to be switched to the up state as illustrated at 21. If the pixel was in the diffractive state as illustrated at 19, the non-switching signal causes no change so that the first strips a remain in the down state. The second strips were in the up state so that the combination of the switching signal and the up strobe pulse has no effect and the pixel remains in the diffractive state illustrated at 21.

By applying the strobe and data signals as illustrated in FIG. 8, each pixel can be switched to a diffractive or non-diffractive state during each frame irrespective of the state of the pixel during the preceding frame. In other words, the combination of signals for switching each pixel to the diffractive or non-diffractive state does not depend on the previous state of the pixel. Blanking of the pixels to the same state, for instance non-diffractive with all the strips in the down state as illustrated in FIG. 8, is necessary only at the start of the first time period, for instance when the device is initially switched on. No further blanking pulses are necessary in order for correct addressing to be achieved.

A disadvantage of the arrangement shown in FIG. 8 is that, when the pixels are in the diffractive state, they are always such that the first strips a are in the down state and the second strips b are in the up state as illustrated at 17, 19 and 21. If any pixel were to remain in the diffractive state for a sufficient time, an internal ionic field could build up and could cause sticking and possible electrochemical degradation of the FLC. Pixels which remain in the non-diffractive state during several consecutive frames do not suffer from this problem because the states of the strips a and b arc reversed during each frame.

Figure 9:
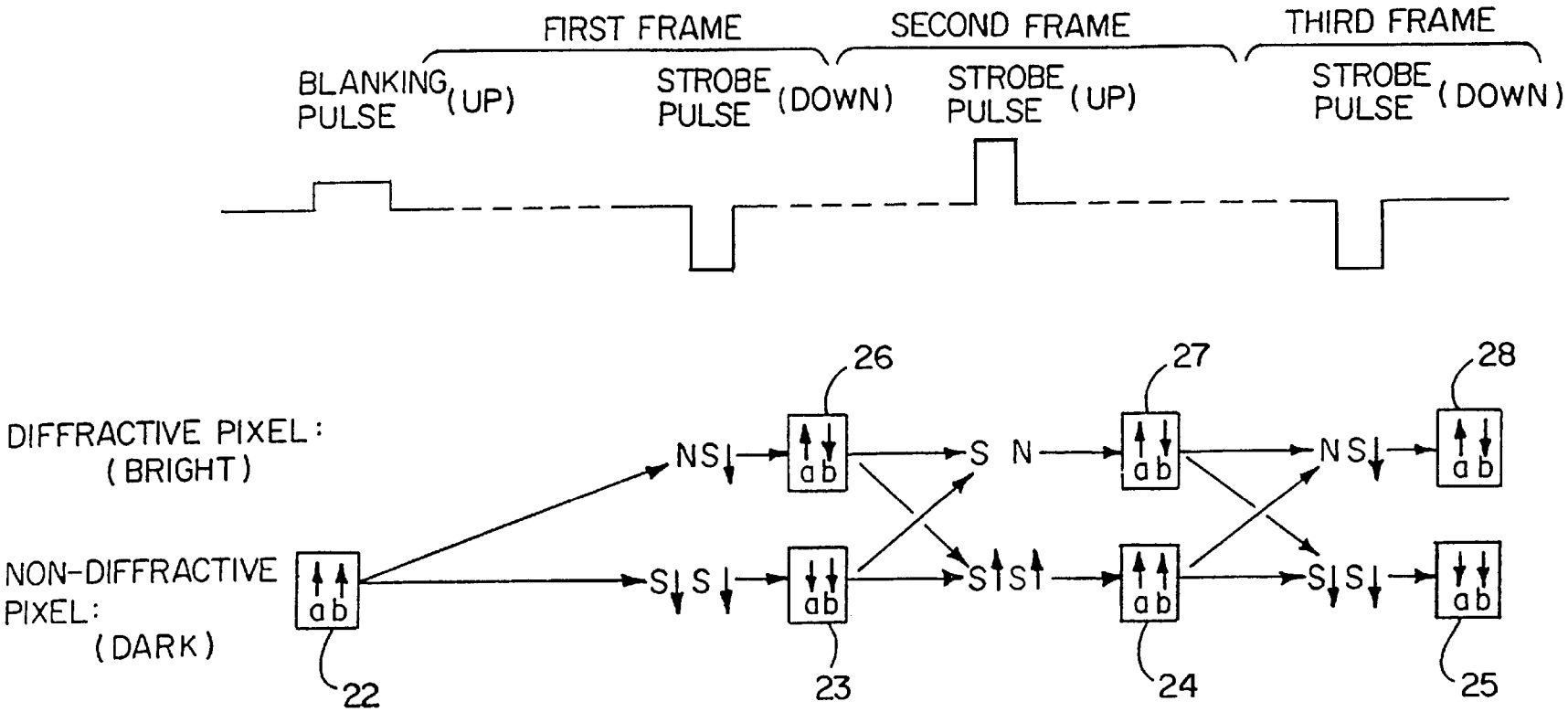
Figure 10:
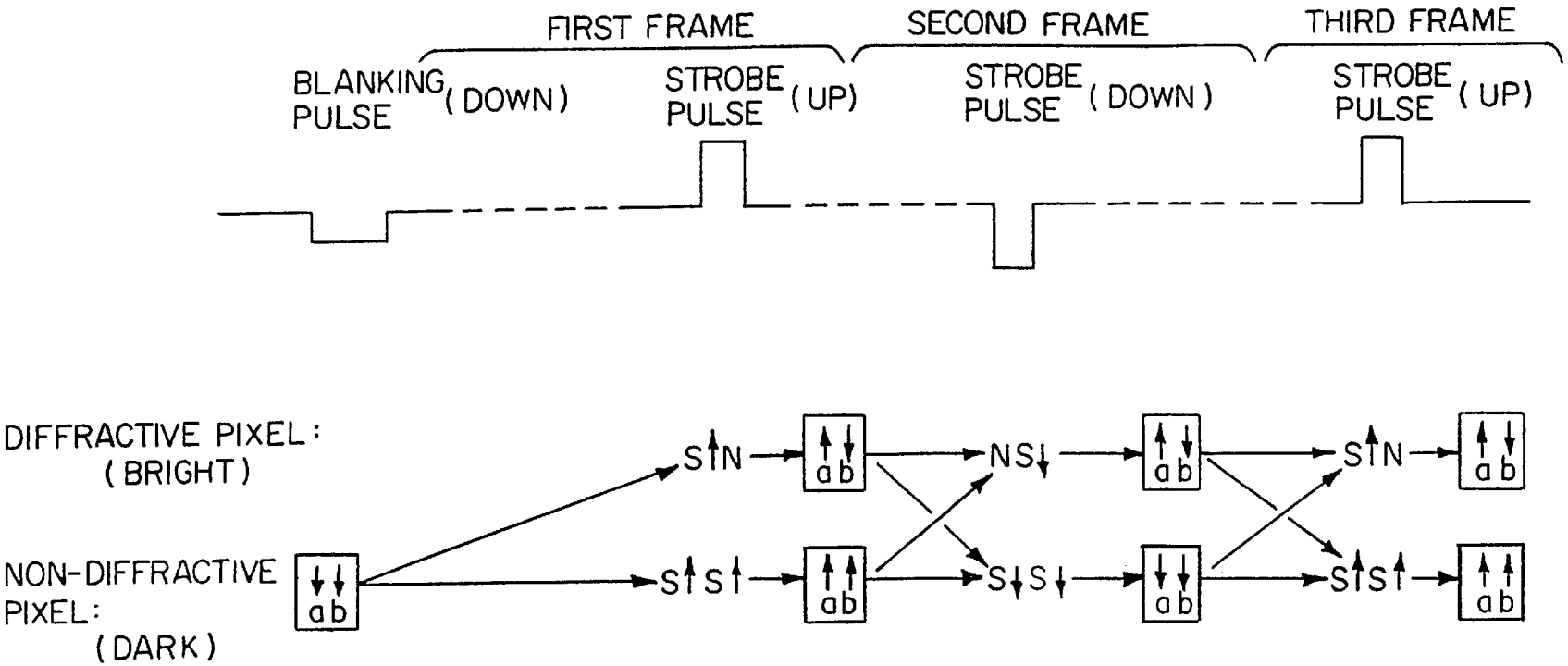

In order to avoid this problem, the device may be operated in accordance with the arrangement illustrated in FIG. 8 for a finite first time period, after which the mode of operation is altered as illustrated in FIGS. 9 and 10.

FIG. 9 illustrates operation during a second time period which follows the first finite time period. All the pixels of the device are again blanked at the start of the second time period but by an up blanking pulse so that the strips a and b are all in the up state as illustrated at 22, However, because the pixel operates diffractively, this corresponds to a non-diffractive state which gives a dark pixel for displays which collect light from the non-zeroth diffraction orders. The strobe pulse during the first frame is then a down strobe pulse and subsequent strobe pulses alternate as shown. Thus, the directions of the blanking and strobe pulses during the second time period are opposite those during the first time period illustrated in FIG. 8. However, the sequence of data signals supplied to the first and second electrodes 1*a* and 1*b* is the same as illustrated in FIG. 8. During the second time period, the states of both the strips a and b alternate for the non-diffractive states as illustrated at 23, 24 and 25.

The diffractive states of the pixels are the same in each frame as illustrated at 26, 27, and 28 with the first strips in the up state and the second strips in the down state. However, the states of the strips in the diffractive mode during the second time period have been reversed compared with the corresponding states during the first time period shown in FIG. 8. By alternating the first and second time periods, compensation may be statistically achieved. For instance, each of the first and second time periods may comprise ten frames. Thus, although display blanking is required at the start of each time period, the loss of brightness and contrast is greatly reduced compared with blanking during each frame.

FIG. 10 illustrates an alternative arrangement for providing compensation to that illustrated in FIG. 9. In this case, the blanking and strobe pulses are the same as shown in FIG. 8. However, the data signals applied to the first and second electrodes are reversed. Thus, during the first frame, a switching signal S is applied to the first electrode 1*a* and a non-switching signal N is applied to the second electrode 1*b* in order to select the diffractive state. This results in the strips a being in the up state and the strips b being in the down state for the diffractive state of the pixels during the second time period illustrated in FIG. 10.

Figure 11:
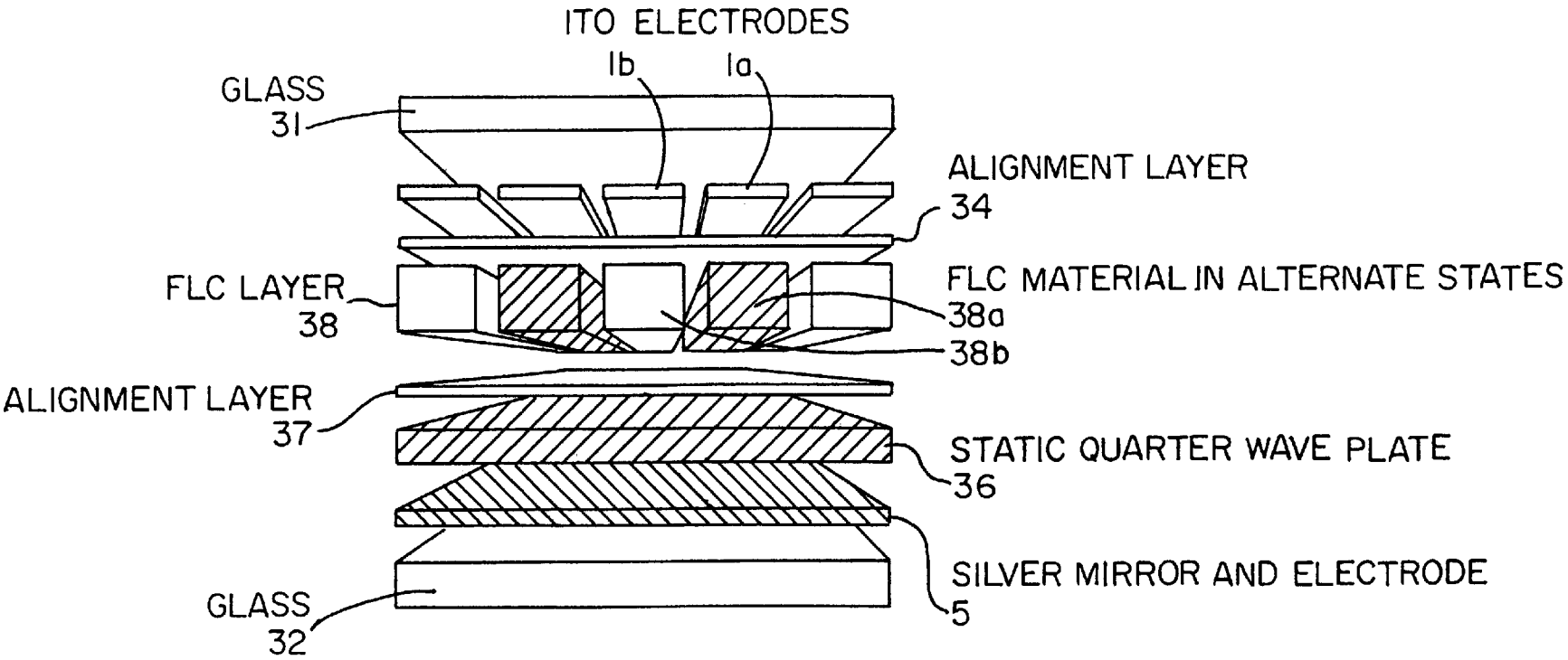
FIG. 11 is an exploded view of a pixel of the LCD of FIG. 4.
Figure 12:
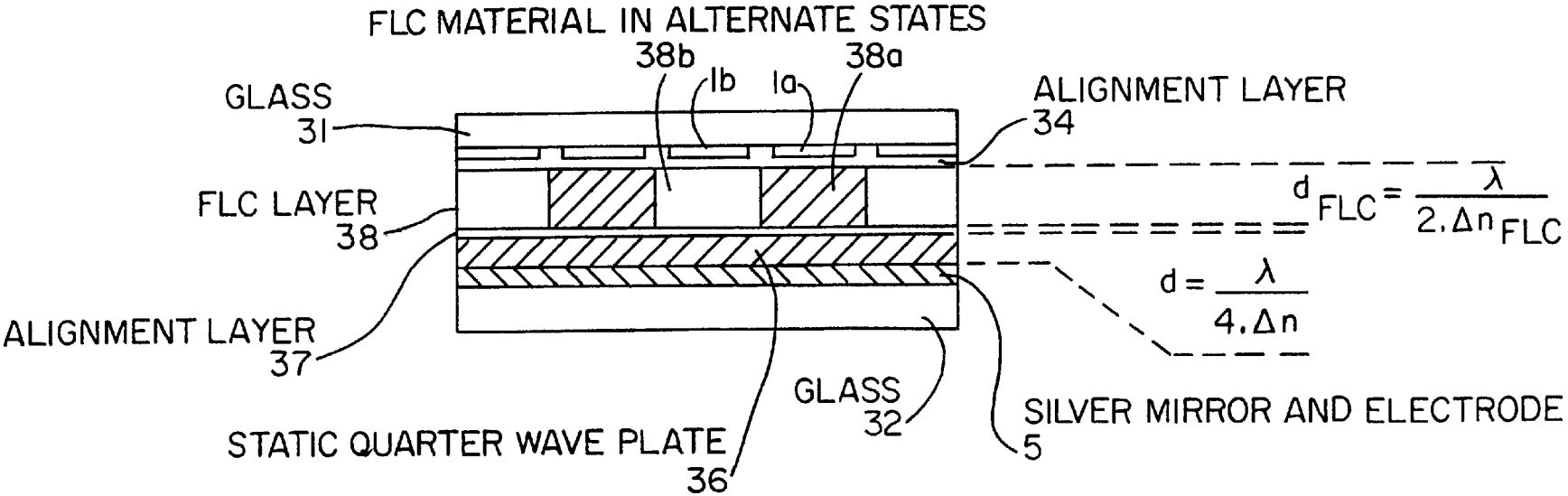
FIG. 12 is a cross-sectional view of the pixel of FIG. 11.

FIGS. 11 and 12 show a reflection-mode diffractive pixel of a display panel using the techniques illustrated in FIGS. 4 to 10. The panel comprises a rectangular array of rectangular or substantially rectangular pixels, only one of which is shown in FIGS. 1 and 12. The panel comprises upper and lower glass substrates 31 and 32. The upper substrate 31 is coated with a transparent conducting layer of indium In oxide (ITO) which is etched to form elongate interdigitated electrodes 1*a* and 1*b*. The electrodes are covered with an alignment layer 34 for a ferroelectric liquid crystal material. In particular, the alignment layer 34 is formed by obliquely evaporating silicon oxide at 84 degrees to the normal to the substrate 31 so as to induce the C1 state in ferroelectric liquid crystal material, for instance of the type known as SCE8 available from Merck. For instance, the alignment layer 34 may have a thickness of approximately 10 nanometers.

A combined mirror and electrode 5 is formed on the glass substrate 32 by depositing silver to a thickness of approximately 100 nanometers. A static quarter waveplate 36 is formed on the silver mirror and electrode 35. This may be provided by spinning on a mixture of a reactive mesogen RM257 (available from Merck) in a suitable solvent such as a toluene/xylene mixture with a photoinitiator. This is cured for approximately ten minutes under ultraviolet light in an atmosphere of nitrogen. The thickness of the plate 36 is controlled, for instance by varying the mix ratios of the materials and the spin speed so that it acts as a quarter waveplate for a predetermined bandwidth in the visible spectrum, for instance centred about 520 nanometers. The thickness d is given by the expression $$d = \frac{\lambda}{4 \cdot \Delta n}$$

where λ is the wavelength of the centre of the band and Δn is the difference between the ordinary and extraordinary refractive indices of the material of the quarter waveplate 36. The quarter waveplate 36 therefore typically has a thickness of the order of 800 nanometers.

A further alignment layer 37 is formed on the quarter waveplate 36, for instance as described hereinbefore for the alignment layer 34. The substrates 31 and 32 are then spaced apart, for instance by spacer balls of two micrometer diameter, and stuck together so as to form a cell which is filled with the ferroelectric liquid crystal material to form a layer 38. The spacing provides a layer of ferroelectric liquid crystal material which provides a half wave of retardation so that the liquid crystal layer acts as a half wave retarder whose optic axis is switchable as described hereinafter. In particular, the ferroelectric liquid crystal layer has a thickness d given by $$d = \frac{\lambda}{2\Delta n_{FLC}}$$

where $\Delta n_{FLC}$ is the difference between the ordinary and the extraordinary refractive indices of the ferroelectric liquid crystal material.

In order to optimise the brightness of the display, the reflectivity of each interface should preferably be reduced, for instance by applying antireflection coatings to the substrate 31 and by optically burying the electrodes 1*a* and 1*b*.

The electrodes 1*a,* 1*b* and 5 are arranged as shown in FIG. 4.

For each pixel, the electrode S acts as a common electrode which is connectable to a reference voltage line, for instance supplying zero volts, for strobing data to be displayed at the pixel. Alternate ones of the elongate electrodes 1*a* and 1*b* are connected together to form two sets of interdigitated electrodes which are connected to receive the data signals described hereinbefore. Each pixel is switchable between a reflective state and a diffractive state.

Figure 13:
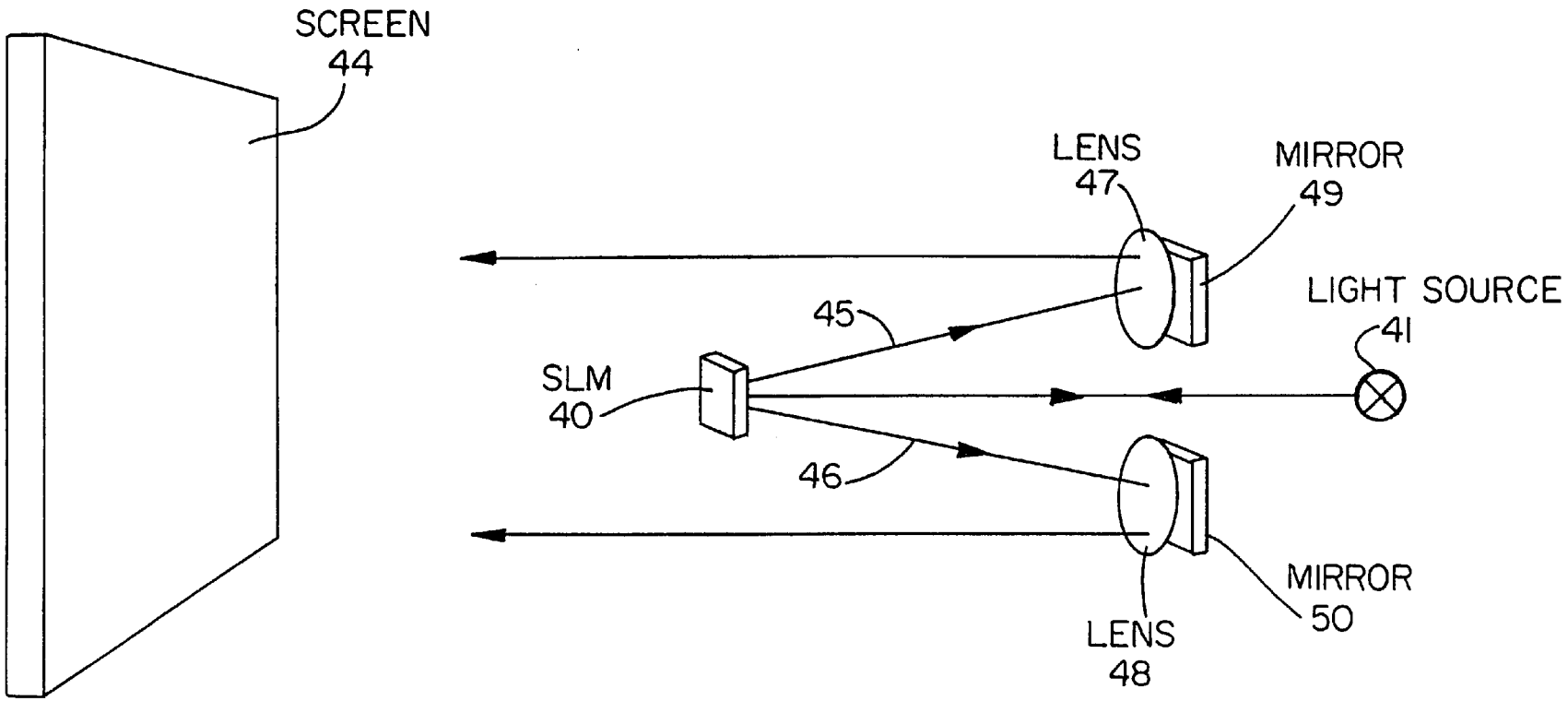
FIG. 13 is a schematic diagram of a projection display including an LCD of the type shown in FIG. 4.

FIG. 13 illustrates a projection display using an SLM 40 having pixels of the type shown in FIGS. 11 and 12. The SLM 40 is illuminated by a light source 41. Projection lenses 47 and 48 and mirrors 49 and 50 project an image displayed by the SLM 40 onto a screen 44.

Light from the light source 41 is incident normally on the SLM 40. Each pixel which is in the reflective mode reflects the incident light normally back so that the reflected light is not projected by the optical elements 47 to 50. Thus, a "dark" pixel is imaged on the screen 44. Each pixel in the diffractive mode deflects the incident light into the non-zero diffractive orders, mainly into the positive and negative first orders as illustrated by light rays 45 and 46. The light from each such pixel is thus imaged to a "bright" pixel on the screen 44.

Although the ferroelectric materials have the advantage of being relatively fast switching, other bistable liquid crystal materials and modes may be used, such as antiferroelectric liquid crystal (AFLC) and bistable nematic modes such as bistable twisted nematic (BTN). Examples of alternative materials and modes together with suitable addressing waveforms are described hereinafter.

Figure 14:
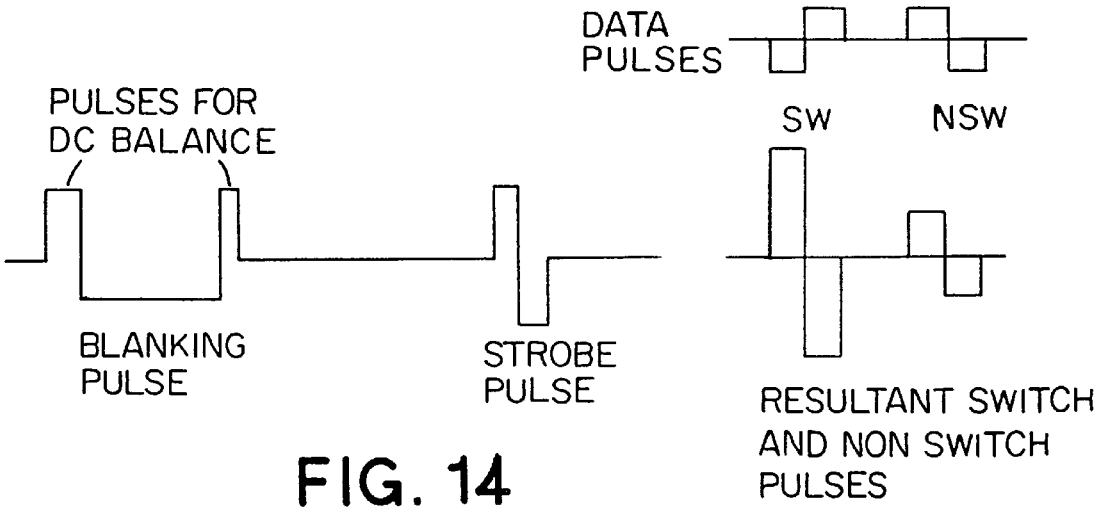
FIGS. 14 to 17 are waveform diagrams illustrating further addressing waveforms which may be used for devices of the type shown in FIG. 4 using other liquid crystal modes.

The addressing waveforms described hereinbefore are appropriate for FLC materials having minima in their τ-V drive voltage range. However, FLC materials which do not have such a minimum may also be used. In this case, addressing waveforms of the type shown in FIG. 14 may be used. The strobe waveform comprises a blanking pulse surrounded by pulses for providing DC balance. These DC balance pulses are not necessary if the strobe pulses arc inverted in alternate frames. The blanking pulse is followed by a bipolar strobe pulse. As described hereinbefore, the blanking pulses required only when the device is switched on and possibly only occasionally thereafter but not as part of each frame refresh cycle. The strobe pulse is inverted for each frame.

Figure 15:
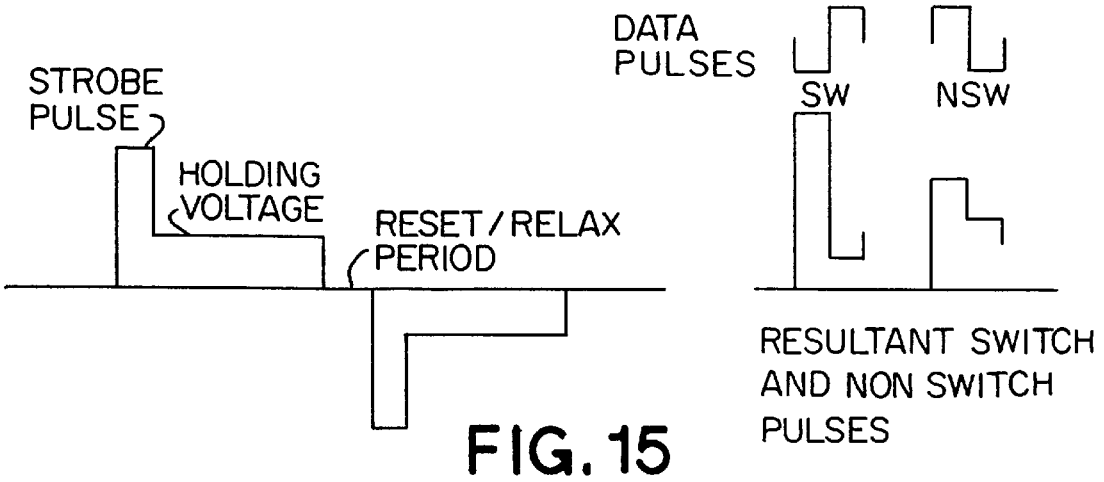

FIG. 15 illustrates a typical addressing waveform for an AFLC. Following the strobe pulse, a holding voltage is required to maintain the pixel in the selected bistable state throughout the frame. Blanking is then achieved by a reset or relax period, during which the AFLC relaxes to the black state. A waveform of this type may therefore be used but omitting the reset or relax period between frames. Further, the initial blanking is unnecessary because the display is initially in its relaxed or black state. The strobe waveform is inverted for alternate frames so as to provide DC balancing.

Figure 16:
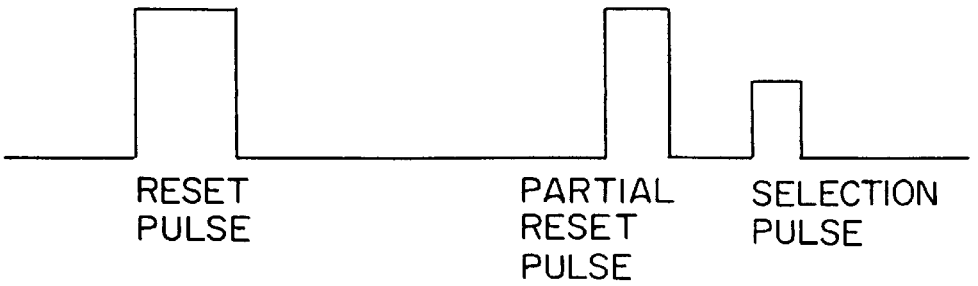

FIG. 16 illustrates a strobe waveform for use in the bistable nematic mode. The waveform comprises a reset pulse followed by a partial reset pulse and a selection pulse which together act as the strobe pulse or signal.

Figure 17:
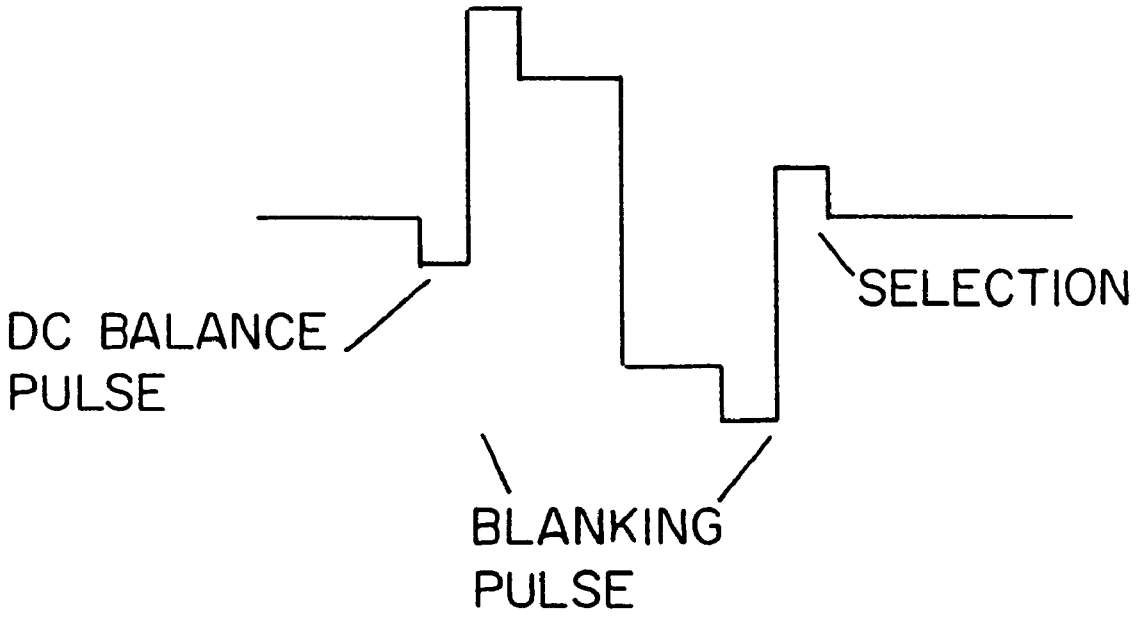

Bistable nematic devices using surface alignment gratings are disclosed in WO 97/14990, which discloses an addressing scheme based on blanking and selection as illustrated in FIG. 17. Again, the blanking pulse is only required initially or occasionally and is not required during each frame refresh cycle.

Figure 18:
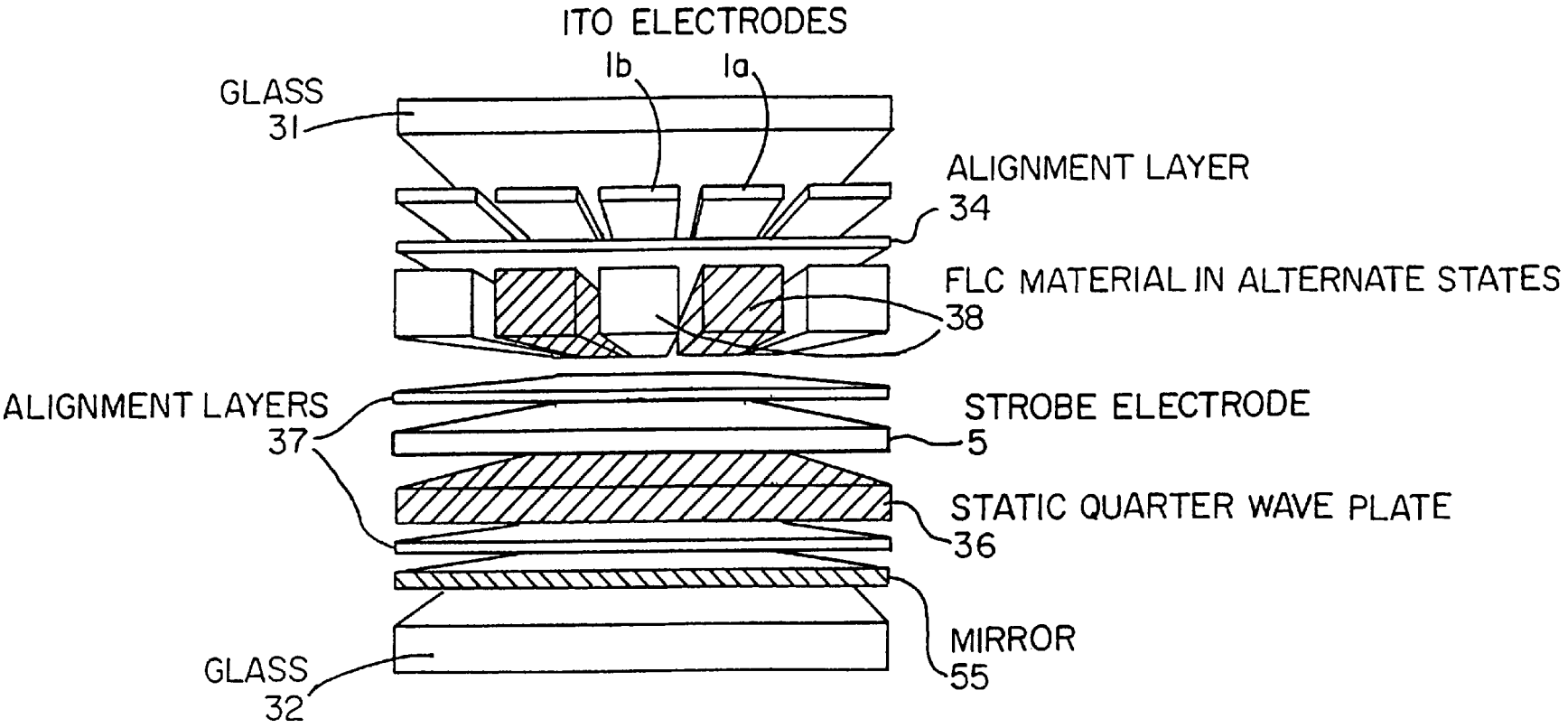
FIG. 18 is an exploded view of a pixel of an LCD constituting another embodiment of the invention.
Figure 19:
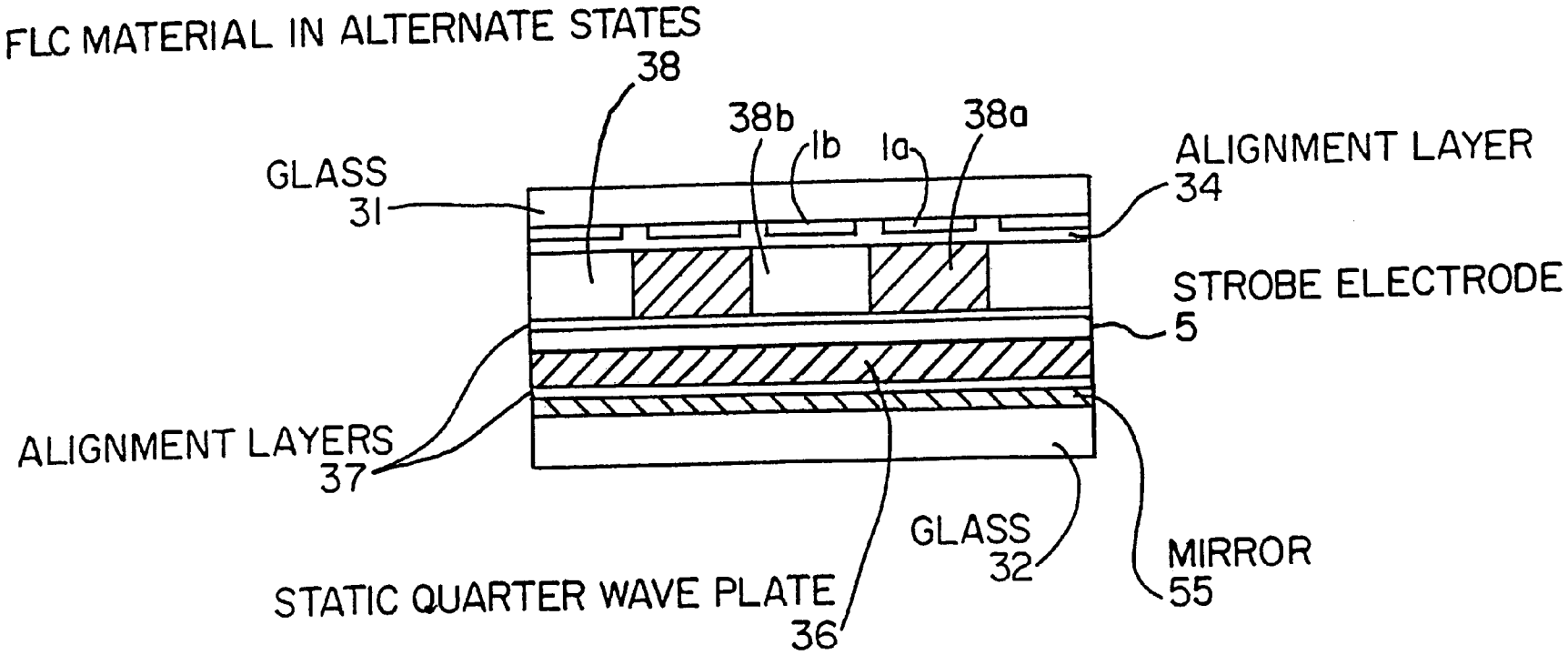
FIG. 19 is a cross-sectional view of the pixel of FIG. 18.

FIGS. 18 and 19 illustrate another device in which the electrode and reflector functions are provided by separate elements. The pixel illustrated in FIGS. 18 and 19 differs from that illustrated in FIGS. 11 and 12 in that the strobe electrode 5 is disposed between the liquid crystal layer 38 with its alignment layer 37 and the static quarter waveplate 36. Such an arrangement has the advantage that the drive voltage is not dropped across the waveplate 36 so that the drive voltage may be reduced. The strobe electrode 5 is transparent and may be made of ITO. A separate mirror 55 is provided between the glass substrate 32 and a further alignment layer 37 for use during formation of the waveplate 36. The mirror 55 does not have to function as an electrode and may therefore be made of dielectric material.

Figure 20:
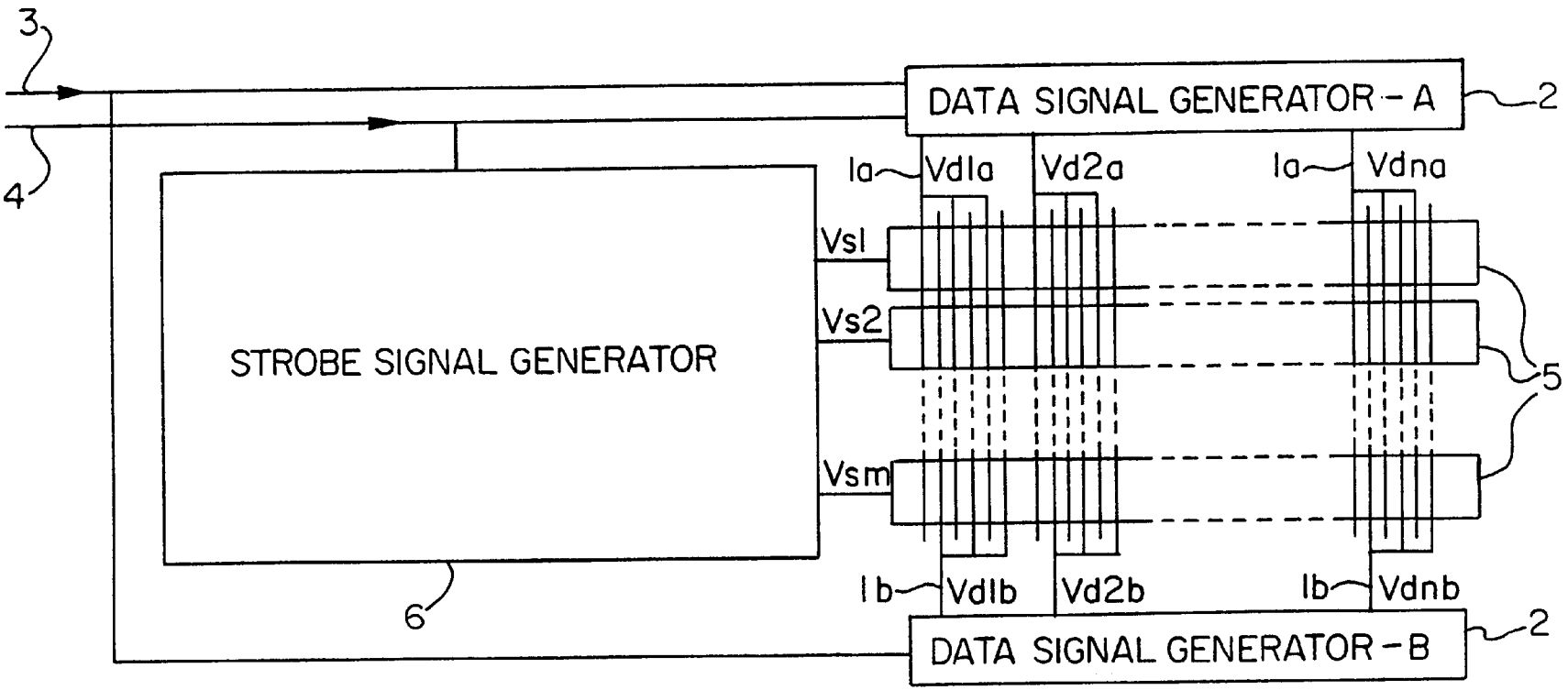
FIG. 20 is a diagrammatic view of an LCD constituting a further embodiment of the invention.

FIG. 20 illustrates another arrangement of the data electrodes. In this case, the data signal generator 2 shown in FIG. 4 is divided into two parts disposed at opposite ends of the data electrodes. The first data electrodes are connected to the data signal generator A and the second data electrodes are connected to the data signal generator B. Such an arrangement has the advantage that the aperture ratio of the pixel is improved because the geometrical layout of the electrodes allows the gaps between the interdigitated pixel electrodes to be minimised.

Although the embodiments described hereinbefore have used digital operation, analogue operation, for instance of the domain growth analogue type, is also possible.

What is claimed is:

1. A diffractive liquid crystal device comprising:

a layer of bistable liquid crystal;

a plurality of strobe electrodes;

a plurality of pairs of data electrodes;

a plurality of picture elements, each of which is formed at an intersection of a respective one of the strobe electrodes and a respective one of the pairs of data electrodes, the data electrodes of each pair being interdigitated at each picture element;

a strobe signal generator for supplying strobe signals to the strobe electrodes such that each strobe electrode receives strobe signals of alternate polarity in consecutive frames of a first time period; and a data signal generator for supplying first and second data signals to first and second ones of the data electrodes, respectively, of each pair in synchronism with each strobe signal, wherein the strobe signals do not include blanking signals between the frames of the first time period, and wherein the first and second data signals comprise, during the first time period: switching signals for selecting a non-diffractive picture element state; a switching signal and a non-switching signal, respectively, in odd frames for selecting a diffractive picture element state; and a non-switching signal and a switching signal, respectively, in even frames for selecting a diffractive picture element state.

2. A device as claimed in claim 1, wherein the strobe signal generator is arranged to supply to each of the strobe electrodes a first blanking signal preceding and of opposite polarity to that of the strobe signal of a first frame of the first time period.

3. A device as claimed in claim 2, wherein the strobe signal generator is arranged to supply the first blanking signals simultaneously to the strobe electrodes.

4. A device as claimed in claim 1, wherein the data signal generator is arranged to supply, during a second time period following the first time period, the first and second data signals comprising: switching signals for selecting a non-diffractive picture element state; a non-switching signal and a switching signal, respectively, in odd frames for selecting a diffractive picture element state; and a switching signal and a non-switching signal, respectively, in even frames for selecting a diffractive picture element state.

5. A device as claimed in claim 2, wherein the strobe signal generator is arranged to supply, during a second time period following the first time period, to each of the strobe electrodes a second blanking signal which is of opposite polarity to that of the first blanking signal and which precedes and is of opposite polarity to that of the strobe signal of a first frame of the second time period.

6. A device as claimed in claim 5, wherein the strobe signal generator is arranged to supply the second blanking signals simultaneously to the strobe electrodes.

7. A device as claimed in claim 3, wherein the strobe signal generator is arranged to supply, during a second time period following the first time period, to each of the strobe electrodes a second blanking signal which is of opposite polarity to that of the first blanking signal and which precedes and is of opposite polarity to that of the strobe signal of a first frame of the second time period.

8. A device as claimed in claim 7, wherein the strobe signal generator is arranged to supply the second blanking signals simultaneously to the strobe electrodes.

9. A device as claimed in claim 1, wherein the strobe signals in a first frame of the first time period are of the same polarity.

10. A device as claimed in claim 1, wherein the bistable liquid crystal is ferroelectric liquid crystal.

11. A device as claimed in claim 1, wherein the bistable liquid crystal is antiferroelectric liquid crystal.

12. A device as claimed in claim 1, wherein the bistable liquid crystal is bistable nematic liquid crystal.

* * * * *